US008084733B2

(12) United States Patent
Russ, IV et al.

(10) Patent No.: US 8,084,733 B2
(45) Date of Patent: Dec. 27, 2011

(54) SYSTEMS AND METHODS FOR DECREASING SETTLING TIMES IN MS/MS

(75) Inventors: Charles William Russ, IV, Sunnyvale, CA (US); Frank Erich Kuhlmann, Los Altos, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 194 days.

(21) Appl. No.: 12/617,028

(22) Filed: Nov. 12, 2009

(65) Prior Publication Data

US 2010/0051798 A1 Mar. 4, 2010

Related U.S. Application Data

(62) Division of application No. 11/537,355, filed on Sep. 29, 2006, now Pat. No. 7,638,762.

(51) Int. Cl.
*H01J 49/02* (2006.01)

(52) U.S. Cl. ..... 250/282; 250/281; 250/286; 250/287; 250/299; 250/300

(58) Field of Classification Search ..... 250/281–283, 250/286–288, 299, 300
See application file for complete search history.

(56) References Cited

U.S. PATENT DOCUMENTS

| | | | | |
|---|---|---|---|---|
| 6,674,068 | B1 | 1/2004 | Kammei | |
| 7,078,686 | B2 | 7/2006 | Roushall et al. | |
| 7,119,331 | B2 | 10/2006 | Chang et al. | |
| 7,638,762 | B2 | 12/2009 | Russ, IV et al. | |
| 2002/0121597 | A1 * | 9/2002 | Tanner et al. | 250/288 |
| 2002/0145110 | A1 * | 10/2002 | Holle | 250/287 |
| 2005/0029448 | A1 | 2/2005 | Chang et al. | |
| 2006/0016985 | A1 * | 1/2006 | Roushall et al. | 250/292 |

FOREIGN PATENT DOCUMENTS

GB 2416620 2/2006

OTHER PUBLICATIONS

GB Application No. 0718025.0 GB Search Report dated Mar. 13, 2008.

Notice of Allowance dated Aug. 14, 2009 in U.S. Appl. No. 11/537,355.

* cited by examiner

*Primary Examiner* — Michael Maskell

(57) ABSTRACT

Systems and methods are provided for optimizing the performance of a mass spectrometer system when multiple measurements are made. For example, the total settling time of different components or stages of a mass spectrometer, such as a tandem mass spectrometer, are decreased by optimally ordering the measurements.

13 Claims, 8 Drawing Sheets

SYSTEMS AND METHODS FOR DECREASING SETTLING TIMES IN MS/MS

CROSS-REFERENCE TO RELATED APPLICATIONS

The present application is a divisional application under 37 C.F.R. §1.53(d) and 35 U.S.C. §121 of U.S. patent application Ser. No. 11/537,355 entitled SYSTEMS AND METHODS FOR DECREASING SETTLING TIMES IN MS/MS to Charles William Russ IV, et al. and filed on Sep. 29, 2006. Priority is claimed to the parent application under 35 U.S.C. §120. The entire disclosure of U.S. patent application Ser. No. 11/537,355 is specifically incorporated herein by reference.

BACKGROUND OF THE INVENTION

The present invention relates generally to mass spectrometry and more particularly to systems and methods for optimizing the performance of a mass spectrometer system having multiple stages, such as a tandem mass spectrometer.

Mass spectrometry is an analytical technique used to measure the mass-to-charge ratio (m/z) of ions. A mass spectrometer is a device used for mass spectrometry, and produces a mass spectrum of a sample to find its composition. This is normally achieved by ionizing the sample and separating ions of differing masses and recording their relative abundance by measuring intensities of ion flux. A typical mass spectrometer comprises three parts: an ion source, a mass analyzer, and a detector.

Tandem mass spectrometry involves two or more stages of mass selection or analysis, usually separated by a stage of fragmentation. A tandem mass spectrometer is capable of multiple rounds of mass spectrometry. For example, in a first stage, one mass analyzer can isolate the ions of one compound from many compounds entering a mass spectrometer. The isolated compound ions ("precursor ions") can then be fragmented in a second stage that includes a fragmentation region such as a collision cell. Compound ions are typically confined to the collision cell and stabilized via a multipole, and fragmented via collision-induced dissociation (CID) with inert gas molecules. A second mass analyzer then analyzes/separates the fragment ions produced from the compound ions, and the fragment ions are detected using a detection system. The result is a mass spectrum of the fragment ions for the isolated compound ions, commonly referred to as a MS/MS spectrum.

Often, a user may require the first mass analyzer to isolate many compounds consecutively, each of which may have many fragments that are to be analyzed by the second mass analyzer. Each time a new precursor ion or fragment is measured, the mass spectrometer requires time to stabilize the voltages, electrical fields and/or magnetic fields. The time it takes to stabilize the various system components is called the settling time. Thus, the overall analysis may take a significant amount of time. Additionally, the many compounds may be introduced into the first mass analyzer concurrently and over a limited time frame, such as across a liquid chromatography peak. For higher accuracy, repeated measurements of each transition from a precursor ion to its fragments may need to be made in the time frame a compound ion enters the mass spectrometer. As a competing concern for accuracy, the time spent on a single measurement, called the dwell time, should be as long as possible.

The time spent on a measurement is hindered by the time spent for the mass spectrometer to settle into a new setting for a new measurement.

Accordingly, it is desirable to provide systems and methods to obtain measurements at a faster acquisition rate and/or to maintain or increase the time spent on a single measurement, e.g., the dwell time.

BRIEF SUMMARY OF THE INVENTION

The present invention provides systems and methods for optimizing the performance of a mass spectrometer system. According to one aspect, the settling times of different components or stages of a mass spectrometer, such as a tandem mass spectrometer, are advantageously reduced or minimized.

In one embodiment, during method set-up, the user inputs a list of parameters or parameter sets. Parameter sets might be used to set up the mass spectrometer for a specific measurement, e.g., a measurement of a transition from one precursor ion to a fragment ion. In this case, each parameter of a set of parameters can be, but need not be, associated with a setting of a different stage or component of the mass spectrometer system. The parameter sets may include pairs, triplets, or higher numbers of parameters. For example a triplet of parameters may include the mass/charge setting of the first mass analyzer, the collision energy (CE) and the mass/charge setting of the second mass analyzer. From the list of parameters, a group of parameter deltas is calculated. A parameter delta is a difference between the same parameter of consecutive sets. The group of parameter deltas calculated includes, in one aspect, a subgroup of all parameter deltas possible for all orders of the list. In another aspect, the list is ordered such that a total settling time decreases where a settling time of a stage is related to a corresponding parameter delta. The dwell time and/or the acquisition rate may also be increased.

In an embodiment, the total settling time of a given order of the list of parameters is also calculated. In another embodiment, the ordering minimizes a function of the parameter deltas. The function may be a sum of the maximum parameter delta of each consecutive set of parameters. The function may also account for non-linearity in the relationship of a settling time to a parameter delta, and constrain a maximum value of a parameter delta.

In some embodiments, the parameter list is a cyclical list. The size of the list may vary from two or three to hundreds or thousands of parameters. Examples of parameters of a set include a mass/charge setting of a first mass analyzer, a mass/charge setting of a second mass analyzer, and a collision energy associated with a collision cell. In one embodiment, the mass spectrometer is a triple quadrupole instrument.

According to a further aspect of the present invention, a mass spectrometer system is provided that includes two or more stages, each stage having an associated settling time when a setting for that stage is changed. The mass spectrometer also includes a control system including means for receiving parameters, e.g., a list of sets of parameters, logic for calculating a group of parameter deltas, and logic for ordering the list such that the total settling time is reduced or minimized.

According to a further aspect of the present invention, an information storage medium is provided that typically includes, or stores, a plurality of instructions for decreasing a total settling time of a mass spectrometer having at least two stages. In one embodiment, the instructions include instructions to receive a list of at least three pairs of parameters for X and Y, where X is associated with a setting of a first stage and Y is associated with a setting of a second stage. In one aspect, additional parameters, such as settings for other stages, may be included in the list. The instructions also typically include instructions to calculate a group of parameter deltas, where a parameter delta is a difference between a parameter of consecutive pairs, and where a settling time of a stage is related to a corresponding parameter delta. Further, the instructions typically include instructions to order the list such that the total settling time decreases.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings.

DETAILED DESCRIPTION OF THE INVENTION

Embodiments of the present invention are directed to systems and methods for decreasing the total settling time of a mass spectrometer, particularly a triple quadrupole (QQQ) mass spectrometer. When achieving a decrease of the total settling time, one can either use the gained time to increase the dwell time for some or all of the measurements, thereby keeping the cycle time and the acquisition rate constant. Or, one can keep the dwell time constant, thereby decreasing the cycle time and increasing the acquisition rate. Or, one can choose a compromise between the two aforementioned choices, e.g., increases the dwell time for some measurements and/or decrease the cycle time and/or increase the acquisition rate for some measurements. For example, a user could choose to increase the dwell time a bit and increase the acquisition rate a bit. One skilled in the art will appreciate that embodiments of the invention may be applied to many different types of mass spectrometers, which may have many different input parameters. The invention can work for any MS instrument that includes an analyzer in which different settings are scanned or stepped through in order to transmit ions of different mass/charge ratios, including Single Quadrupole, QTOF, QQQ and Magnetic Sector Mass Spectrometers.

Figure 1:
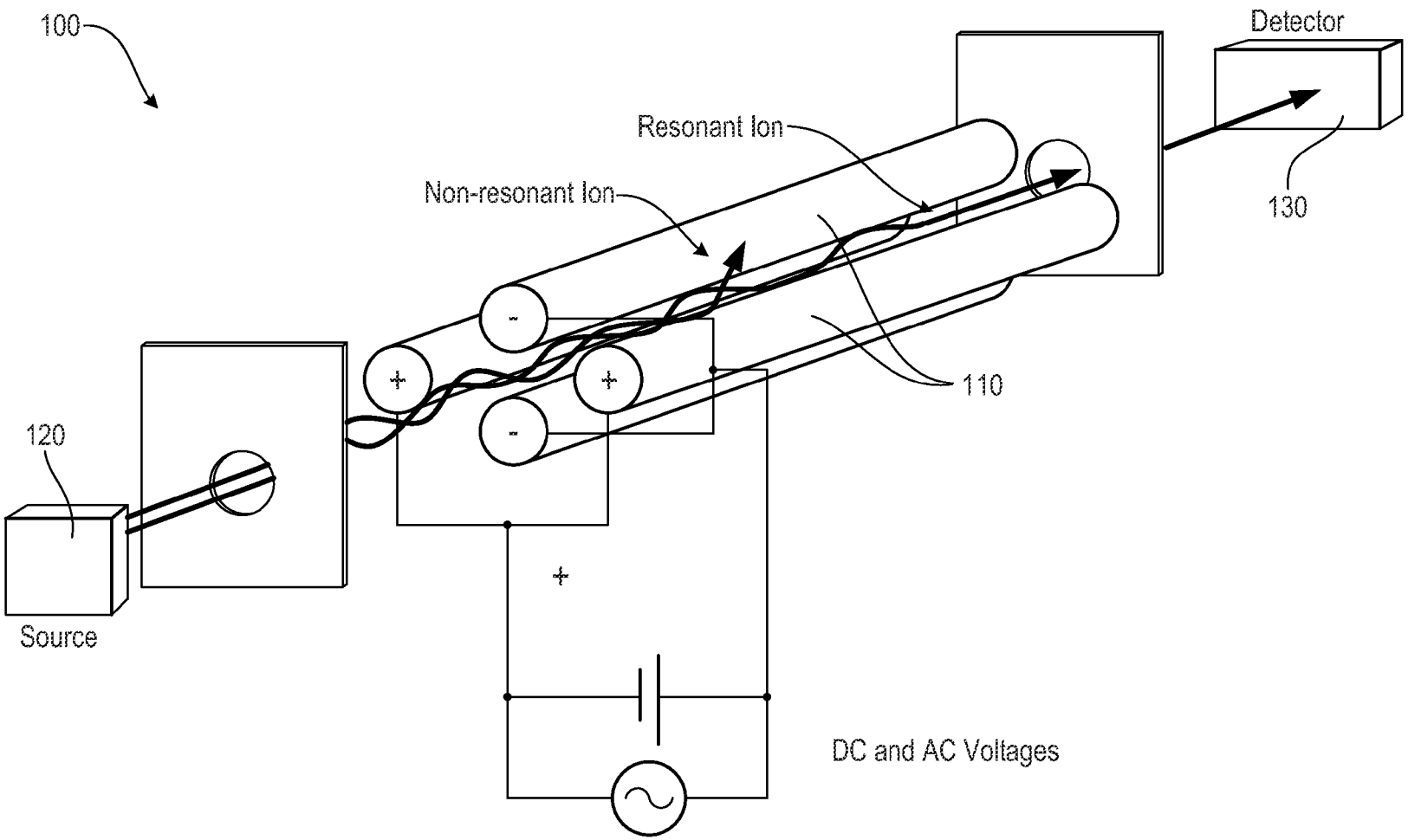
FIG. 1 illustrates a quadrupole mass spectrometer, which may be used in implementing embodiments of the present invention.

As an illustration of one type of mass spectrometer, FIG. 1 shows a quadrupole mass analyzer 100 including four parallel rods 110 that have DC and AC potentials applied thereto. The electric potentials are varied to bring ions of different mass-to-charge ratios (m/z) into focus on the detector 130 and thus build up a mass spectrum or analysis. Ions produced in the source 120 of the analyzer 100 are focused and passed along the middle of the quadrupoles. An ion's motion will depend on the electric fields in the analyzer so that only ions of a particular m/z will be in resonance and thus pass through to the detector 130. Note that the trajectory of the ions through the quadrupole is typically more complex than what is shown in FIG. 1.

To detect a new ion with a different m/z, the settings for the AC and DC potentials applied to the rods 110 are changed so that the proper resonance is achieved. The appropriate settings for the AC and DC potentials are usually dictated by one or more parameters, such as m/z. The time to change the electronics is not instantaneous. The settling time is the time for the instrument electronics to come to suitable equilibrium so that accurate measurements can be made. For mass analyzer 100, the settling time is dependent upon the time it takes for the quadrupole AC and DC voltages to stabilize. For other types of mass spectrometers, the settling time may be dependent upon the stabilization of other instrument components.

The settling times normally vary by an amount related to the change being made to the parameter m/z from one measurement to the next. Typically, a smaller change means less settling time is required. If small changes are made, a series of measurements may be done faster than if larger changes are made. For example, a list of a series of measurements with an m/z parameter order of 100, 200, and 150 would require more settling time than a series of measurements with an order of 100, 150, and 200. Thus, an overall time savings for a series of measurements may be achieved by optimizing the order of the measurements, e.g., by optimizing the order of the parameter change list.

Additionally, an increase in the speed of a mass spectrometer may increase the accuracy of measurements as time restrictions can impact the accuracy of measurements. For example, sample ions may be introduced into the mass analyzer only over a limited time window. The introduction of a chemical or biological mixture into the mass analyzer often occurs in the following successive steps. A chromatograph takes the mixture carried by liquid or gas and separates it into components or smaller sub-mixtures as a result of differential distributions of the solutes as they flow around or over a stationary liquid or solid phase. After the separated components or sub-mixtures exit the chromatograph in a gas or liquid stream, ionization may be done by many techniques well known in the art, including, but not limited to, electrospray ionization, fast atom bombardment, thermospray and atmospheric pressure chemical ionization. The ions are then injected into the mass analyzer.

Figure 2:
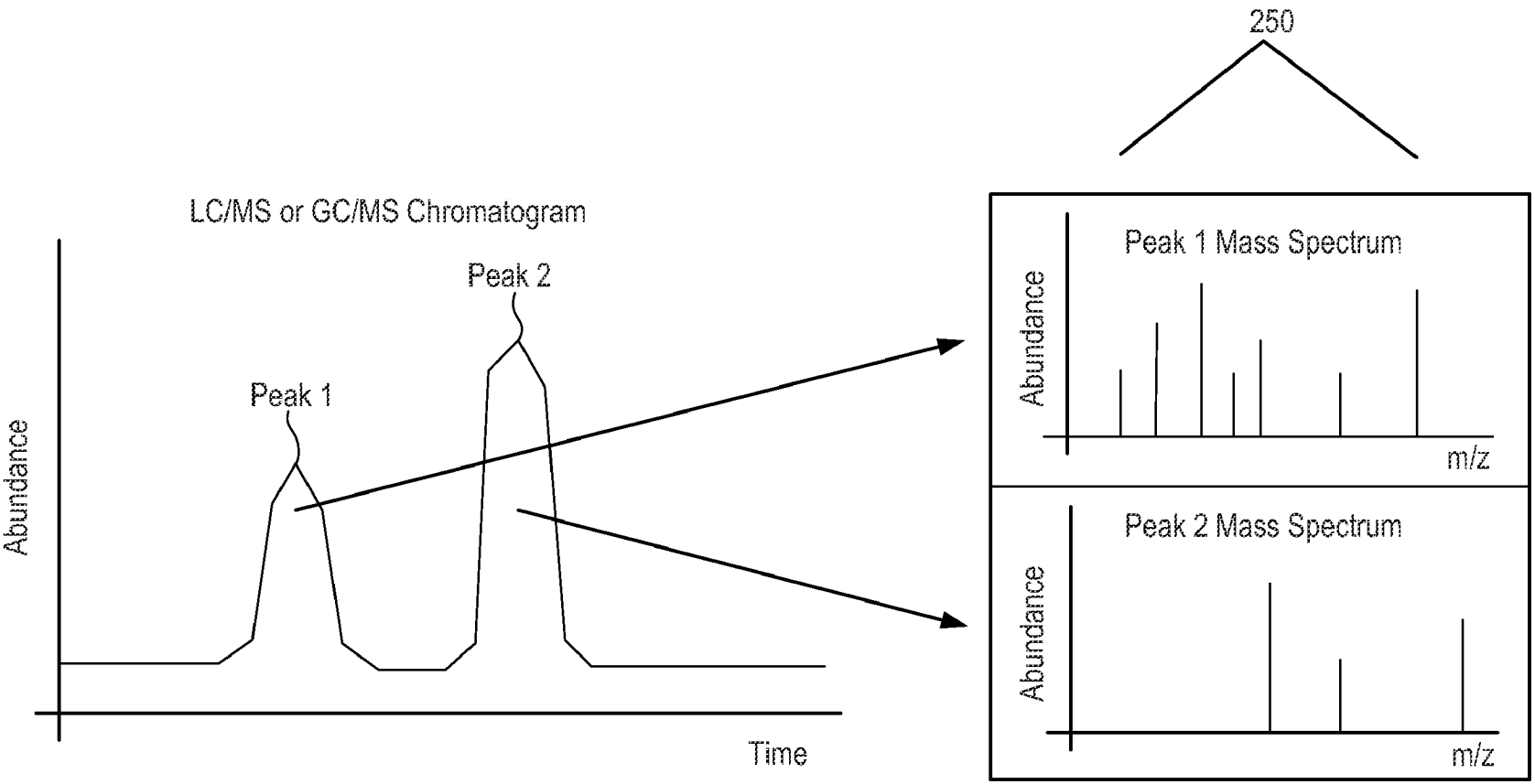
FIG. 2 illustrates an output of a chromatograph-mass spectrometer system, which may be used in implementing embodiments of the present invention. The chromatograph may be a liquid chromatograph (e.g., LC/MS system), or a gas chromatograph (e.g., GC/MS system). Other separation systems, e.g., capillary electrophoresis (CE/MS), may be used.

As the chromatograph operates, the separated components or sub-mixtures in the gaseous or liquid effluent are introduced into the mass spectrometer one at a time. Also, as a component or sub-mixture is eluting from the separation column during a limited time, it is introduced into the mass spectrometer for a limited time window. The chromatogram of FIG. 2 shows the time window, being the width at the base of two sub-mixtures eluting as Peak 1 and Peak 2. Because the measurement of a component or sub-mixture must occur over a limited amount of time, time is of the essence to obtain accurate measurements.

Compounding the effect of the limited time available for measurement is the existence of many compounds (ions) in a peak. FIG. 2 shows the related mass spectra of the two peaks in the GC/MS or LC/MS chromatogram. Each chromatography peak can contain multiple ions which show up as different peaks 250 in the mass spectrum. Thus, there is limited time to measure all of the ions in the peak. Plus many measurements at a specific parameter, such as m/z, need to be taken to obtain sufficient ion statistics to record an accurate mass spectrum.

In FIG. 2, the first chromatography peak has seven ions that are analyzed, which show up as seven peaks in the mass spectrum. Over the time of this peak, one needs sufficient measurements of each of the seven ions of interest. It is possible to measure one ion for the first ⅐th of the peak, another ion for the second ⅐th of the peak and so on. However, this mode could be problematic in that some ions might be measured more accurately at the center of the peak than the ions measured at the edges of the peak. For example, since the recorded ion intensity is a measure for both the absolute amount of a compound in a peak as well as the amount relative to other compounds in the sub-mixture of a mixture, those amounts cannot be accurately determined if the ion intensity is recorded at different times during elution of the compound. In order to have more uniform measurements, the mass analyzer cycles through measuring each of the seven ions multiple times across the elution of a chromatographic peak. Thus, measurements of a particular ion occur at varying points along the chromatographic peak. Accordingly, the settings, such as the AC/DC potentials, of the mass analyzer must be changed frequently, causing the settling time to have an even greater detrimental impact on the acquisition rate or dwell time.

Figure 3:
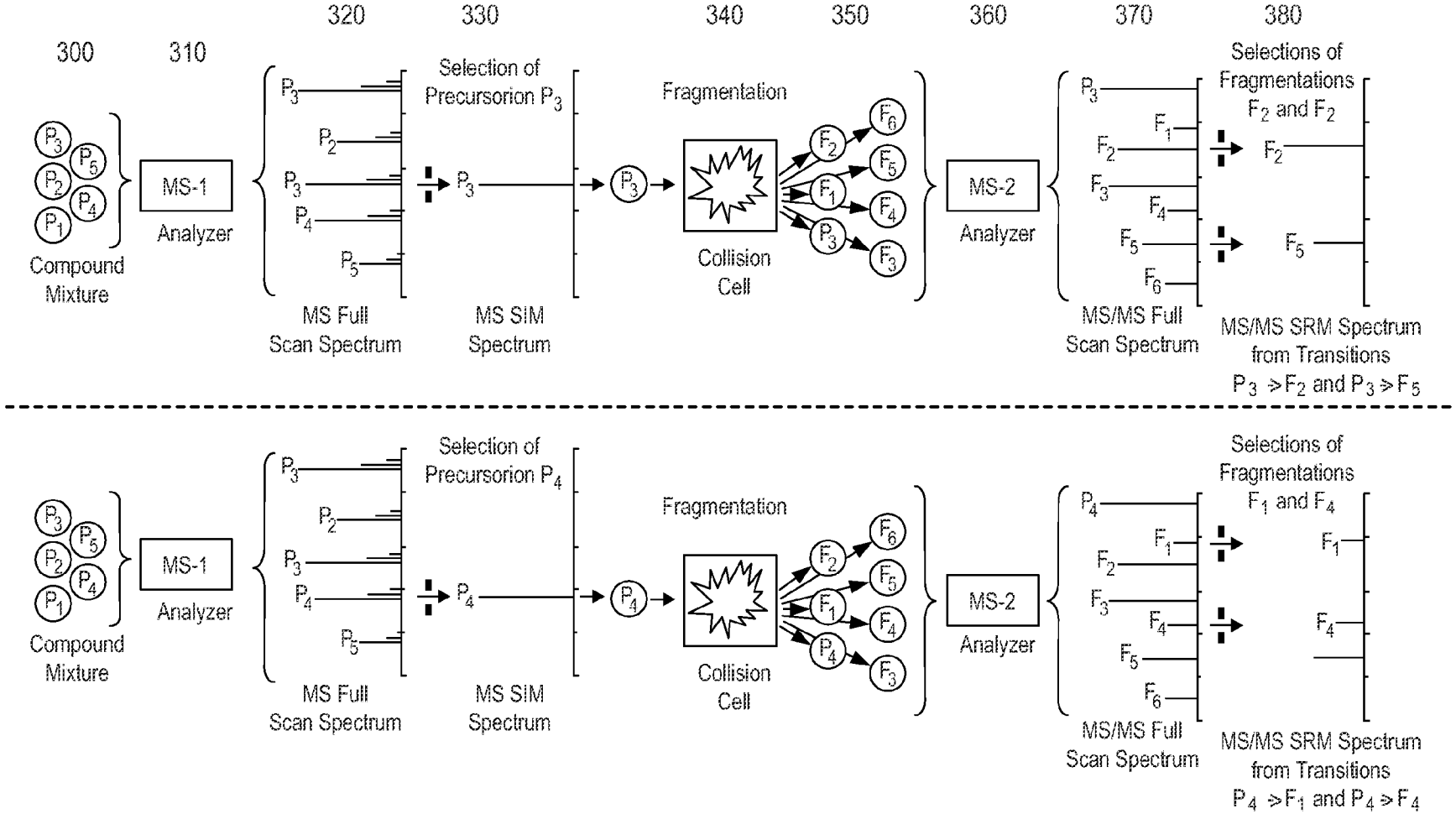
FIG. 3 illustrates the function and an output of a tandem mass spectrometer, which may be used in implementing embodiments of the present invention.

The speed of measurements becomes more important when performing tandem mass spectrometry, and even more so when performing multistage tandem mass spectrometry. FIG. 3 illustrates the function of a tandem mass spectrometer, and some typical mass spectra that can be obtained from a compound mixture 300 using a tandem mass spectrometer. Using only mass analyzer MS-1 310, a full scan mass spectrum 320 can be obtained, which shows ions of all compounds that make up the compound mixture. The compound mixture may be a sub-mixture from a sample corresponding to a single chromatography peak. Also the analyzer can be set to transmit only one ion and a Single Ion Monitoring (SIM) spectrum 330 can be recorded.

In tandem mass spectrometry, a further analysis of one or multiple ions of the mass analysis 320 is obtained. Here, a precursor ion 330, which is selected in the first mass analyzer 310, is subsequently fragmented via collision-induced dissociation (CID) in a collision cell 340 or various other fragmentation processes, resulting in fragment ions 350. The resulting fragment ions 350 are then separated using a second mass analyzer 360 and a full scan MS/MS spectrum 370 can be recorded. Alternatively, the second mass analyzer MS-2 can be set to one or several fixed settings to only transmit one or several ions, resulting in the recording of a Single Reaction Monitoring MS/MS spectrum 380. Each of the different fragment ions 380 can be recorded during the time window that the parent or precursor ion 330 is being analyzed.

Thus, across a single chromatographic peak, the need to cycle through each precursor ion 320 is compounded by the need to cycle through the fragment ions found in the resulting mass analyses, such as in 380. Additionally, the settings of the different components or stages of the mass spectrometer, each with its own settling time, may change each time a new precursor/fragment ion transition is to be measured. It would thus be beneficial for the settling time between the measurements of each precursor/fragment ion transition to be as small as possible.

Figure 4:
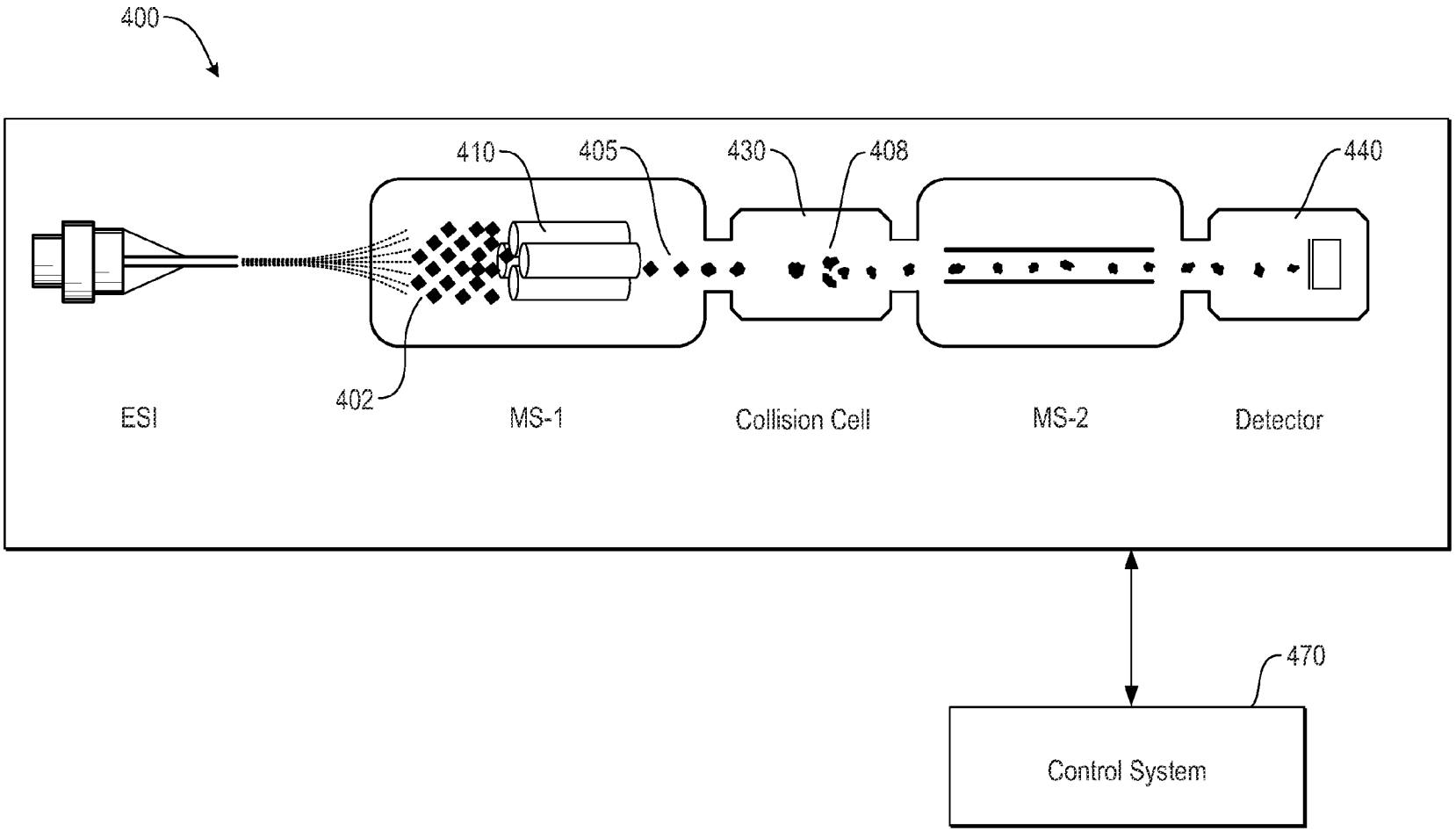
FIG. 4 illustrates a tandem mass spectrometer system according to an embodiment of the present invention.

FIG. 4 shows an example of a tandem mass spectrometer system 400 including, or coupled with, a control system 470 according to an embodiment of the invention. The ions 402 are inserted by an electro-spray ionization (ESI) nozzle. During any one time, focusing element 410 of mass analyzer MS-1 filters out one precursor ion, such as ion 405. After precursor ion 405 is filtered out, it enters a collision cell 430. In one embodiment, collision cell 430 operates by sending precursor ion 405 through a gas, typically an inert gas, which causes parent ion 405 to fragment into smaller ions 408, a process know in the art as collision-induced dissociation (CID). Other embodiments can use other collision cells such as Photoionization, Surface Ionization or Electron Impact cells. Collision cell 430 may have a setting that corresponds to the kinetic energy of parent ion 405, typically the difference in the voltage potential between the mass analyzers MS-1 and MS-2. Collision cell 430 may also focus the fragment ions 408 into the second mass analyzer MS-2. MS-2 then filters out the fragment ions of interest, so that they may be detected by a detector 440. When mass analyzers MS-1 and MS-2 begin to analyze, respectively, a new precursor and fragment ion (a new transition), there must be a respective change in a setting, for example a change to the mass-to-charge ratio (m/z) of the new precursor or fragment ion to be filtered.

An instrument typically referred to as Triple Quadrupole, QQQ or QqQ, does not have to consist of three quadrupoles. Typically, the first and second mass analyzer (denoted by a capital Q) are quadrupoles, but other devices and multipoles may be used. The collision cell in between can include a quadrupole, another multipole, or other suitable device. For example, some embodiments of collision cells have used ringstacks or other devices to confine and transmit ions in the presence of a collision gas.

Control system 470 is provided to control overall operation of mass spectrometer device 400, including automatic tuning operations such as, for example, controlling focusing element 410, the energy of the collision cell 430, and the detector 440 by automatically adjusting instrument control parameters, such as m/z. Control system 470 implements control logic that allows system 470 to receive user input and provide control signals to various system components.

In the use of mass spectrometers, such as system 400, there is a desire to spend as much time on each precursor/fragment ion transition as possible to obtain good ion statistics, and to measure each transition as many times as possible in a short period of time. The number of transitions a user may want to examine could be as many as 100-200 or even more, and is increasing with the use of fragment ions as qualifiers and new quantitation applications which are developed to determine the amount or concentration of more compounds in more complex sample matrices in shorter separation times.

The total time required to measure all precursor/fragment ion transitions once is called the "cycle time". The cycle time includes the sum of the "dwell time", "settling time", "transit time" and "overhead" associated with each transition. One desires to make the cycle time as short as possible so as to obtain a suitable number of measurements across a chromatographic, e.g. liquid chromatographic (LC), peak. For example, LC peaks are usually on the order of 2 to 10 seconds wide at half of their maximum intensity (FWHM), and 4 to 20 seconds wide at the base. Therefore, one usually wants 10 to 20 measurements across that peak so the total cycle times should be about 0.1 to about 1.0 seconds long.

The dwell time is the time spent on one precursor/fragment ion transition per cycle. The longer the dwell time is, the greater the integration of ions, and therefore, the better the ion statistics and thus the accuracy of the measurement. A user normally wants to maximize a dwell time, but will trade off the dwell time for an increased number of measurements across a chromatographic peak, if many compounds (transitions) need to be measured in a chromatographic time scale. Generally, dwell times are the same for all transitions, but they need not be.

The transit time is the time it takes for an ion to travel from one end of the system 400 to another. The transit time is typically on the order of 0.5 msec and is mass dependent. Normally, one can't measure a new transition until the ions from the previous transition are gone from the system. The transit time should be the lower limit to the cycle time.

The overhead is the time for data transfer and processing and should be kept minimal in a properly designed system. This should not limit the cycle time.

The total settling time is the time for the system 400 to come to suitable equilibrium so that accurate measurements of all the transitions of a parameter list can be made. As mentioned above, any component or stage of the system 400 may have an associated settling time, including mass analyzers MS-1 and MS-2 and collision cell 430. The settling time could potentially be different for each change of transition.

In one embodiment, when achieving a decrease of the total settling time, one can either use the gained time to increase the dwell time for some or all of the measurements, thereby keeping the cycle time and the acquisition rate constant. In another embodiment, one can keep the dwell time constant, thereby decreasing the cycle time and increasing the acquisition rate. In yet another embodiment, one can choose a compromise between the two aforementioned choices based on a tradeoff.

For input into the mass spectrometer system 400, a user constructs a table or list of desired precursor/fragment ion transitions to be measured. The list of transitions may be input into control system 470. In one embodiment, the user specifies a list of transitions and total cycle time, and the system 400, including the control system 470, optimizes the sequence (order) of the measurements to advantageously reduce or minimize a total settling time. The total cycle time is a compromise of having significant dwell time and a sufficient number of measurements for each transition across an LC peak.

Table 1 shows a simple example of possible input data corresponding to the user input of the list of desired transitions to be measured, assuming that all ions measured are singly charged. There are six sets of mass pairs for the precursor/fragment ion transitions. If there were more parameters or stages for a mass spectrometer system, a set would have more than two parameters. The ordering of the list of mass pairs dictates the total and individual settling times, given a preset cycle time and/or dwell time. If the dwell time is preset, then the cycle time is dictated by the ordering.

TABLE 1

Initial user list input into mass spectrometer system

| Mz1 (Da) | Mz2 (Da) |
|---|---|
| 128 | 110 |
| 128 | 73 |
| 250 | 125 |
| 250 | 75 |
| 252 | 127 |
| 252 | 77 |

In one embodiment, the mass is the parameter that is used to set the AC/DC potentials of a quadrupole mass analyzer. In other embodiments, another parameter may be used. In yet another embodiment, the mass may be a setting other than for the AC/DC potentials.

The unified atomic mass unit (u), or dalton (Da), is 1/12 of the mass of one atom of carbon-12. As used herein, a Da also refers to one (u) divided by one unit of charge (e). Thus, mass as used herein also refers to an m/z value. The mass under the Mz1 column corresponds to the precursor ion and the mass under the Mz2 column corresponds to a fragment ion of the precursor ion. Thus, in one embodiment, Mz1 controls a setting of mass analyzer MS-1, and Mz2 controls a setting of mass analyzer MS-2.

According to an embodiment of the invention, the change in the value of the mass parameter is computed. Table 2 shows the changes of the mass parameter from one mass pair to another. Each change is marked as a delta of the corresponding mass parameter. For example, Delta Mz1 shows the change between the precursor ions of a consecutive mass pair.

A greater parameter delta requires a greater settling time. Thus, the total settling time required for one cycle is related to the total sum of the parameter deltas. Note that when the measurements are cyclical, the first Delta Mz1 corresponds to the change from the last mass on the list to the first mass on the list. This is denoted by using parentheses.

TABLE 2 initial user list including calculated parameter deltas

| Mz1 (Da) | Mz2 (Da) | Delta Mz1 (Da) | Delta Mz2 (Da) | Max. Delta |
|---|---|---|---|---|
| 128 | 110 | (124) | (33) | 124 |
| 128 | 73 | 0 | 37 | 37 |
| 250 | 125 | 122 | 52 | 122 |
| 250 | 75 | 0 | 50 | 50 |
| 252 | 127 | 2 | 52 | 52 |
| 252 | 77 | 0 | 50 | 50 |
| | Total | 248 | 274 | 435 |

As can be seen above, mass analyzer MS-1 has a total of 248 Daltons of transitions with 2 "large" (>49) transitions. Mass analyzer MS-2 has a total of 274 Daltons of transitions with 4 being "large". The last column shows the maximum of the two deltas for each transition. In some embodiments, each maximum delta is related to the settling time of a given transition. As a first approximation, one may take the maximum delta to be linearly proportional to the settling time between transitions, Thus, if the list of transitions is ordered such that the maximum delta is decreased, then the settling time will be decreased. If the cycle time is fixed, the dwell time will be increased.

Table 3 shows a new list of mass pairs that has been ordered to have smaller maximum deltas, and a lower total settling time. In this example, the total deltas for mass analyzer MS-1 is virtually unchanged, with a total of 248 Daltons of transitions and 2 "large" transitions. However, now mass analyzer MS-2 has a total delta of only 108 Daltons with only 1 being "large". Also, the sum of the maximum deltas for all transitions has decreased from 435 to 335.

TABLE 3 new list including calculated parameter deltas

| Mz1 (Da) | Mz2 (Da) | Delta Mz1 (Da) | Delta Mz2 (Da) | Max. Delta |
|---|---|---|---|---|
| 250 | 125 | (122) | (15) | 122 |
| 252 | 127 | 2 | 2 | 2 |
| 252 | 77 | 0 | 50 | 50 |
| 250 | 75 | 2 | 2 | 2 |

TABLE 3-continued

| new list including calculated parameter deltas | | | | |
|---|---|---|---|---|
| Mz1 (Da) | Mz2 (Da) | Delta Mz1 (Da) | Delta Mz2 (Da) | Max. Delta |
| 128 | 73 | 122 | 2 | 122 |
| 128 | 110 | 0 | 37 | 37 |
| | Total | 248 | 108 | 335 |

Besides the mass parameter associated with the two mass analyzers, the energy setting of a collision cell, typically represented by the difference in voltage potentials between the first and second mass analyzer, may also have an associated settling time. This collision energy may also be incorporated into the input list and ordered such that the total settling time is decreased. A description of embodiments of the present invention for ordering the list now follows.

Figure 5:
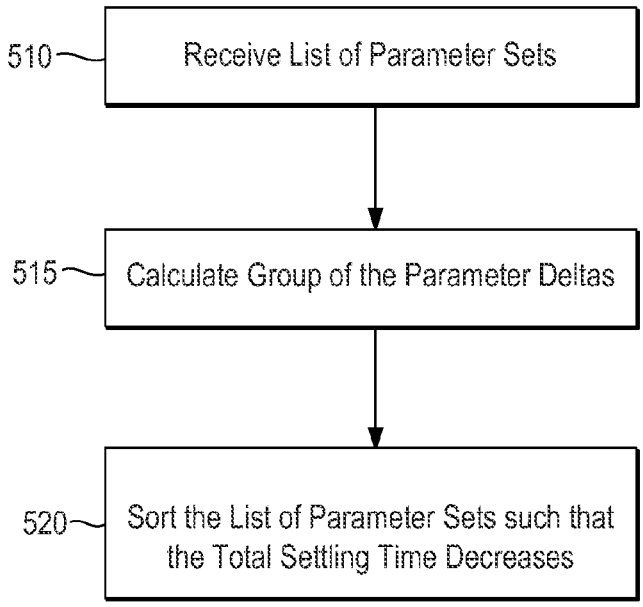
FIG. 5 illustrates a method for decreasing settling time according to an embodiment of the present invention.

FIG. 5 illustrates a method 500 for decreasing the total settling time of a mass spectrometer system according to an embodiment of the present invention. The mass spectrometer may have multiple stages, such as mass analyzer stages, collision cells, fragmentation chambers, or any component of a mass spectrometer whose settings vary from one measurement to another.

In Step 510, a list of N parameter pairs (sets) X and Y is received. Each parameter is associated with a setting of a stage of a mass spectrometer system. For example, X could be a setting of a first mass analyzer, such that ions with an m/z ratio corresponding to the X values in the list are filtered and/or detected. X or Y could also be associated with settings of other components of a mass spectrometer system. In some embodiments, additional parameters may be added to each set, making the size of a set greater than two.

In one embodiment, a user inputs the parameters into the mass spectrometer system directly. In another embodiment, the list is input into another instrument, such as a computer, and the initial list or subsequent ordered lists are input into the mass spectrometer system.

In step 515 a group of parameter deltas for the list of parameter deltas received in step 510 is calculated. In some embodiments, a parameter delta for some or all possible orderings of the list is calculated. Thus, for N pairs of parameters, there would be up to N! different permutations (orderings) possible, each with a different delta for every parameter of a set. The calculated deltas are stored or buffered.

In step 520, the list of parameters is ordered such that one or more parameter deltas are decreased, thereby decreasing the settling time. In one embodiment, any parameter is chosen as the first parameter in the list. The parameter deltas from the first pair to the other pairs are then examined. The next parameter may be chosen such that the maximum of any of the parameter deltas for the pair or set is the smallest available. The parameter deltas from the second pair to the other available pairs are then examined and the next parameter is chosen appropriately.

In one embodiment, the parameter deltas have the same sign until a parameter with the smallest value is reached, and thus having the same sign for the next parameter delta is not possible. At this point, the sign for the deltas changes, and the parameter values move in the opposite direction. In this manner, the order of the parameters is roughly sorted in ascending/descending and then descending/ascending order. The ordering also may decrease the number of local maximum and minimum values in the list of parameters. In one embodiment, the ordering process provides a continuous change in the values of one of the parameters of the set with only one minimum and one maximum.

In another embodiment, the order of the parameters is sorted in ascending (descending) and then descending (ascending) order. Note that in the ordering process the values of the parameters are compared, thus the values of the parameter deltas are calculated and compared.

Figure 6:
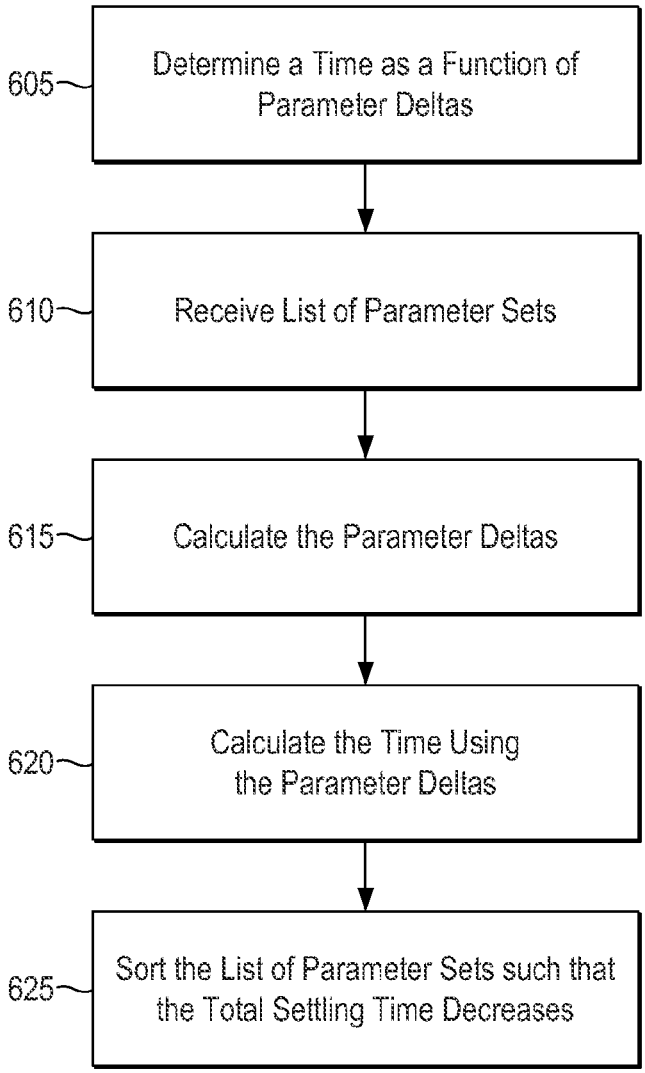
FIG. 6 illustrates a method for decreasing settling time where parameters have non-linear relationship to settling time according to an embodiment of the present invention.

FIG. 6 illustrates a method 600 for decreasing the total settling time of a mass spectrometer system according to an embodiment of the present invention. In step 605, a function of parameter deltas is determined. In one embodiment, the function may give a result of an approximation of a settling time of one or more stages of the mass spectrometer system. The function may differ depending on what parameter deltas are involved. For example, if the parameter deltas are all mass parameters, the function will be different than if the parameters include collision energies.

In some embodiments, the function has the general form of $F(X,Y)=G(X)+H(Y)+I(X,Y)$, where $X=\{x_1, x_2, \ldots x_n\}$ is the list of a parameter associated with a first stage of the mass spectrometer, and $Y=\{y_1, y_2, \ldots y_n\}$ is the list of a parameter associated with a second stage of the mass spectrometer. A parameter pair is made of $\{x_1,y_1\}$. Thus, an example of a parameter delta would be $x_2-x_1$. Sub-function G relates to the settling time of the first stage independent of the settings of other stages. Sub-function H relates to the settling time of the second stage independent of the settings of other stages. Sub-function I relates to aspects of the settling time of one stage that depend or interact with the settling time of another stage.

If the function F is taken to include a sum of the maximum parameter delta for each transition, then these terms would be in sub-function I. If the function F is taken to include an independent sum of each parameter delta for each transition, then these terms would be in sub-functions G and H. Additionally, each sub-function may further include sub-functions that relate a settling time or dwell time to a parameter delta. For example, the dependence of the settling time on a parameter delta may have a quadratic term, an integral term, or a derivative term.

In some embodiments, additional parameters for other stages of the mass spectrometer may be included in the function. For example, a parameter $Z=\{z_1, z_2, \ldots z_n\}$ may be included in each set of parameters. Z may have its own independent sub-functions or other sub-functions regarding interactive settling times. Step 605 may be performed before or after step 610.

In step 610, a list of the parameter pairs X and Y is received. In step 615, a group of parameter deltas is calculated for the list of parameter deltas received in step 610.

In step 620 a time is calculated from the parameter deltas. In one aspect, this is accomplished by inserting the parameter deltas into the function F. In one embodiment where F represents the settling time, the time calculated in step 620 is the settling time. Note that even when a sum of the parameter deltas is taken, a time is being calculated. In one embodiment, the settling times for all possible permutations (orderings) of the list are calculated.

In step 625, the parameters are ordered such that the total settling time decreases. In one embodiment, the ordering with the lowest or minimum settling time is chosen as the final order for taking measurements. In other embodiments, other permutations with lower settling times than the initial ordered list are chosen.

Figure 7:
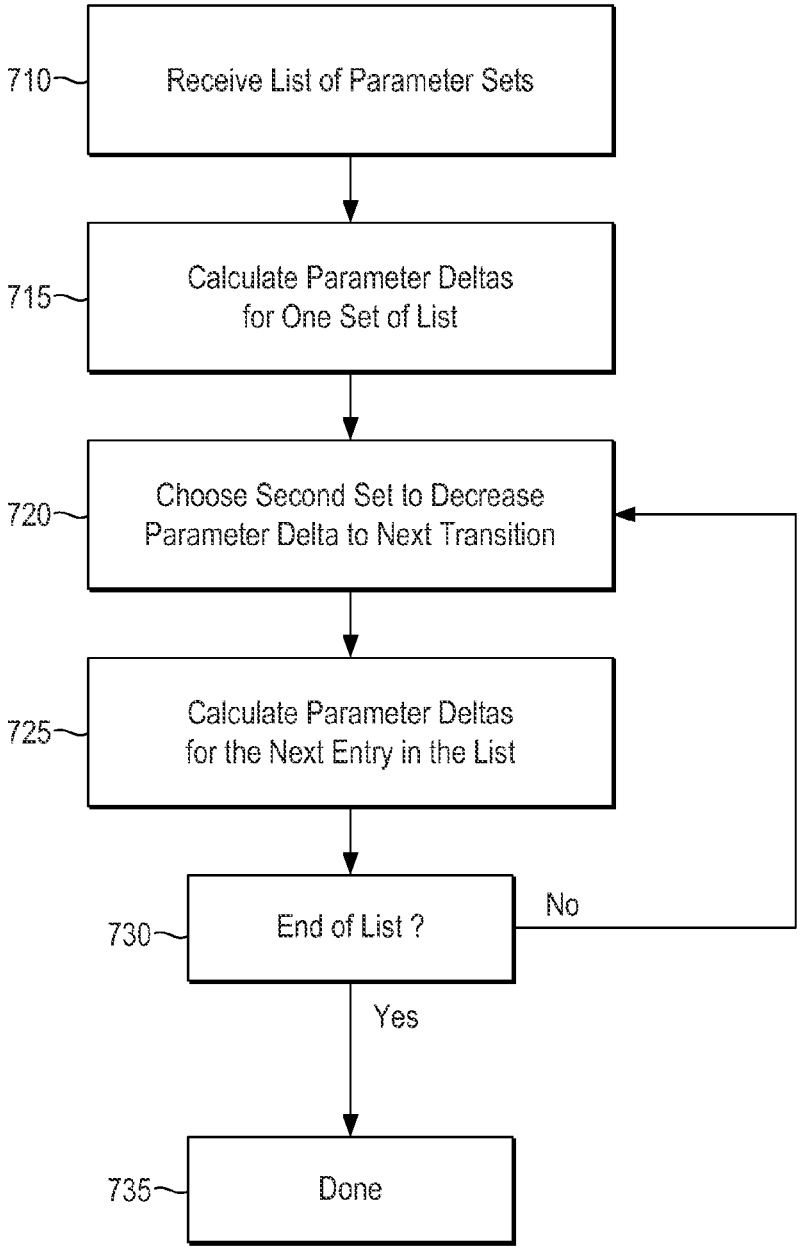
FIG. 7 illustrates a method for decreasing settling time according to an embodiment of the present invention.

FIG. 7 illustrates a method 700 for decreasing the total settling time of a mass spectrometer system according to an embodiment of the present invention. In step 710, a list of the parameter pairs X and Y is received. In step 715, a group of parameter deltas is calculated for one parameter pair in the list compared to all of the other parameters pairs. For example, the parameter deltas from the first pair $\{x_1,y_1\}$ to all other pairs is calculated. In one aspect, the calculation of a parameter delta may include comparing a parameter of two sets to determine if one is closer to the parameter of a third set.

In step 720, a parameter pair for the second entry is selected such that the settling time of the transition is decreased. In one embodiment, the parameter pair with the smallest sum of parameter deltas is chosen. In another embodiment, the parameter pair with the smallest maximum parameter delta is chosen. A constraint that the parameter delta of the current transition stay the same sign as the parameter delta of the last transition may be enforced until this is no longer possible.

In step 725, a group of parameter deltas is calculated for the second parameter pair in the list compared with other available parameter pairs. The process of calculating the parameter deltas for a parameter pair relative to all of the other available parameter pairs and choosing the most suitable parameter pair continues until the end of the list is reached. In step 730, it is determined whether the end of the list is reached. If the end of the list is reached, the method 700 ends at step 735 with an ordered list that decreases the total settling time being achieved.

Figure 8:
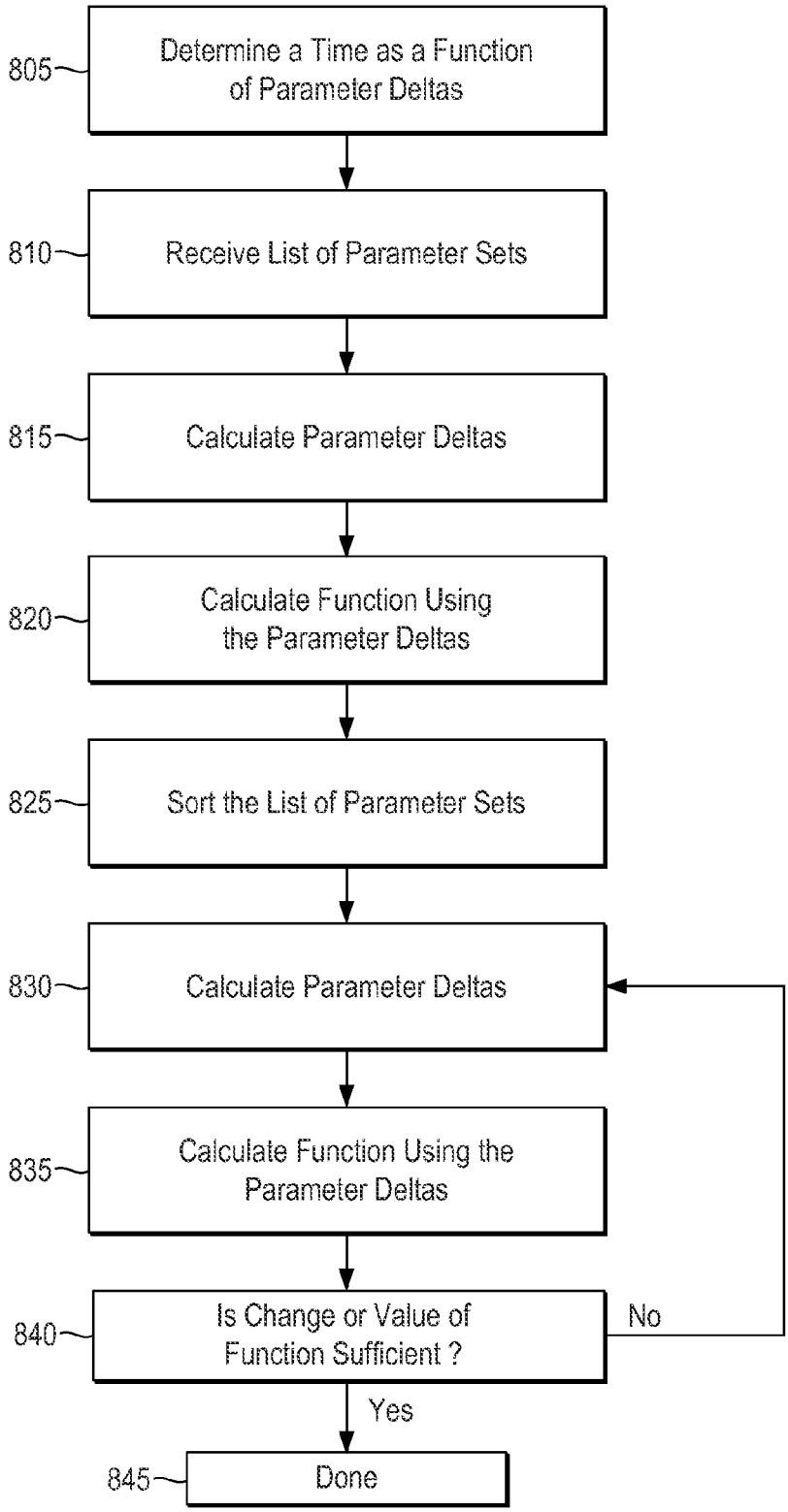
FIG. 8 illustrates a method for decreasing settling time according to an embodiment of the present invention.

FIG. 8 illustrates a method 800 for decreasing the settling time of a mass spectrometer system according to an embodiment of the present invention. In step 805, a function of parameter deltas is determined. In step 810, a list of the parameter pairs X and Y is received. In step 815, a group of parameter deltas is calculated for the list of parameter deltas received in step 810. In one embodiment, only the parameter deltas for the current order of the parameter pairs are calculated.

In step 820, a time is calculated from the parameter deltas. In one aspect, this is accomplished by inserting the parameter deltas into the function F. In the embodiment where F represents the settling time, the time calculated in step 820 is the settling time. In one embodiment, the settling time of the initial order is used to ensure that future orders of the list decrease the settling time. In another embodiment, the settling time is used to determine a new order of the list. Such methods include simulated annealing and Monte Carlo methods, or any suitable method of combinatorial minimization.

In step 825, the list of parameter pairs is sorted. In one embodiment, particularly when the list is extremely large, a relatively small number of pairs are rearranged. In some embodiments, only two pairs are moved. For example, the order of consecutive pairs may be swapped, or two pairs may exchange position. In other embodiments, more than one such change may be made. In other embodiments, changes that include more than two pairs are made.

In step 830, a group of parameter deltas is calculated for the new ordering of the list. Only the parameter deltas that have changed need to be calculated.

In step 835, a time is calculated from the parameter deltas for the new ordering of the list. In step 840, a determination is made whether the time or one part of it has increased or decreased, such that the settling time has sufficiently decreased. If a greater decrease in the settling time is desired or known to be possible, then the method 800 may go back to step 825 to re-order the list. If the decrease is sufficient, the method ends at step 845 with an ordered list achieved.

Methods such as method 800 minimize the function F. The term "minimize" does not require an absolute minimum to be found though, but simply a decrease in the function F.

Code for implementing the methods 500-800, and other control logic, may be provided to control system 470 using any means of communicating such logic, e.g., via a computer network, via a keyboard, mouse, or other input device, on a portable medium such as a CD, DVD, or floppy disk, or on a hard-wired medium such as a RAM, ROM, ASIC or other similar device. These means of communicating may also be used to receive any list of parameters.

Control system 470 may include a stand alone computer system and/or an integrated intelligence module, such as a microprocessor, and associated interface circuitry for interfacing with the various systems, stages and components of mass spectrometer device 400 as would be apparent to one skilled in the art. For example, control system 470 preferably includes interface circuitry for providing control signals to the focusing elements 410 and 420 of the different mass analyzers, and to the collision cell 430 for adjusting its energy.

One skilled in the art will recognize the many ways that the aforementioned methods and systems may be combined to produce different embodiments of the present invention.

While the invention has been described by way of example and in terms of the specific embodiments, it is to be understood that the invention is not limited to the disclosed embodiments. To the contrary, it is intended to cover various modifications and similar arrangements, in addition to those discussed above, as would be apparent to those skilled in the art. Therefore, the scope of the appended claims should be accorded the broadest interpretation so as to encompass all such modifications and similar arrangements.

What is claimed is:

1. A computer-readable information storage medium having a plurality of instructions adapted to direct an information processing device to perform an operation for decreasing a total settling time of a mass spectrometer system having at least two stages, the operation comprising:

(a) receiving a list of at least three pairs of values of parameters X and Y, wherein parameter X is associated with a setting of a first stage and parameter Y is associated with a setting of a second stage;

(b) calculating a group of parameter deltas and assessing settling times, wherein a parameter delta is a difference between two sequential values of the same parameter, wherein a settling time of a stage is related to a corresponding parameter delta;

(c) changing the order of the list and repeating (b): and (d) instructing a mass spectrometer system to perform an MS measurement according to an order of the list for which the total settling time is reduced compared to another order.

2. The information storage medium of claim 1, wherein the operation further comprises assessing the total settling time of an order of the list.

3. The information storage medium of claim 1, wherein the group of parameter deltas calculated is a subgroup of all parameter deltas possible for all orders of the list.

4. The information storage medium of claim 1, wherein the dwell time is increased and/or the acquisition rate is increased.

5. The information storage medium of claim 1, wherein the list is a cyclical list.

6. The information storage medium of claim 1, wherein the operation further comprises receiving a list of values of a parameter Z, wherein parameter Z is associated with a setting of a third stage, wherein each value of parameter Z corresponds to one pair of parameters X and Y.

7. The information storage medium of claim 6, wherein the operation further comprises receiving additional lists of parameters associated with additional stages.

8. The information storage medium of claim 1, wherein the order in (d) minimizes a function of the parameter deltas.

9. The information storage medium of claim 8, wherein the function accounts for non-linearity in the relationship of a settling time to a parameter delta.

10. The information storage medium of claim 1, wherein the MS measurement is performed according to an order of the list for which the total settling time is reduced compared to any other order.

11. A mass spectrometer system comprising the information storage medium of claim 1.

12. The mass spectrometer system of claim 11, comprising a triple multipole mass spectrometer.

13. The mass spectrometer system of claim 11, comprising a QTOF or QQQ mass analyzer.

* * * * *

UNITED STATES PATENT AND TRADEMARK OFFICE

CERTIFICATE OF CORRECTION

PATENT NO. : 8,084,733 B2
APPLICATION NO. : 12/617028
DATED : December 27, 2011
INVENTOR(S) : Charles William Russ, IV et al.

It is certified that error appears in the above-identified patent and that said Letters Patent is hereby corrected as shown below:

In column 12, line 47, in Claim 1, delete "(b):" and insert -- (b); --, therefor.

Signed and Sealed this
Thirteenth Day of March, 2012

David J. Kappos

David J. Kappos
*Director of the United States Patent and Trademark Office*